US005936354A

United States Patent [19]

Smith et al.

[11] Patent Number: 5,936,354

[45] Date of Patent: Aug. 10, 1999

[54] FIELD EMISSION DISPLAY WITH TEMPERATURE SENSING ELEMENT AND METHOD FOR THE OPERATION THEREOF

[75] Inventors: Robert T. Smith, Tempe; Ken K. Foo, Chandler, both of Ariz.

[73] Assignee: Motorola, Inc., Schaumburg, Ill.

[21] Appl. No.: 09/184,457

[22] Filed: Nov. 2, 1998

[51] Int. Cl.[6] ..... G09G 3/10

[52] U.S. Cl. ..... 315/169.3; 315/169.1; 313/336; 445/50

[58] Field of Search ..... 315/169.1, 169.3, 315/169.4, 169.2; 313/309, 310, 336, 351; 445/24, 50

[56] References Cited

U.S. PATENT DOCUMENTS 5,828,163 10/1998 Jones et al. ..... 315/169.4 X
5,834,900 11/1998 Tanaka et al. ..... 315/169.1

*Primary Examiner*—Don Wong
*Assistant Examiner*—Haissa Philogene
*Attorney, Agent, or Firm*—S. Kevin Pickens

[57] ABSTRACT

A field emission display (100) includes a cathode plate (104) having a plurality of electron emitters (112) and ballast resistors (118), an anode plate (120) having an anode (124), and a temperature compensation circuit (130) having an input (142), an output (134), and a current output (138). Input (142) is connected to unregulated voltage (132), output (134) is connected to gate (116), and current output (138) is connected to temperature sensing element (148). Preferably, temperature sensing element (148) is mounted on cathode plate (104) and matches the temperature vs. resistance characteristics of ballast resistors (118). Temperature compensation circuit (130) outputs current (220) to temperature sensing element (148) and receives ballast voltage (230) from temperature sensing element (148) as a function of temperature of cathode plate (104). Temperature compensation circuit (130) outputs gate voltage (238) to adjust electron emission current (114), and subsequently brightness for variations in temperature.

15 Claims, 1 Drawing Sheet

FIELD EMISSION DISPLAY WITH TEMPERATURE SENSING ELEMENT AND METHOD FOR THE OPERATION THEREOF

FIELD OF THE INVENTION

The present invention relates, in general, to field emission displays, and, more particularly, to the adjustment of electron emission current for variations in temperature.

BACKGROUND OF THE INVENTION

Field emission displays (FED's) are well known in the art. A field emission display includes an anode plate and a cathode plate that define a thin envelope. Electron emitters are disposed on the cathode plate and conduct an electron emission current to the anode plate. To control the electron emission current, ballast resistors are provided between the electron emitters and the cathodes. The ballast resistors function to limit the electron emission current through each of the electron emitters. The FED generally requires high resistivity ballast resistors as part of the cathode design. The high resistivity materials used for ballast resistors are generally characterized by a large resistivity change as a function of temperature of the field emission display and cathode plate. In addition, the resistivity change is generally not linear with temperature. This results in a very dramatic change in electron emission current over temperature for the FED, and consequently, a dramatic change in brightness of the FED over temperature.

Also, the ballast resistors do not have identical temperature vs. resistance characteristics from FED to FED. The lack of consistent temperature vs. resistance characteristics of ballast resistors from FED to FED prevents accurate adjustment of electron emission current using conventional temperature sensing elements and circuitry.

Presently, temperature sensing elements can include a thermistor or pn junction, along with complex circuitry to assist in measuring the temperature of the FED and adjusting the electron emission current as a function of the temperature of the FED. However, this combination fails to consistently match the temperature vs. resistance characteristics of the field emission display or the ballast resistors. The result is a field emission display with a variation of brightness over changes in temperature.

Accordingly, there exists a need for a method of adjusting electron emission current in a field emission display for variations in temperature.

BRIEF DESCRIPTION OF THE DRAWINGS

Referring to the drawings.

Figure 1:
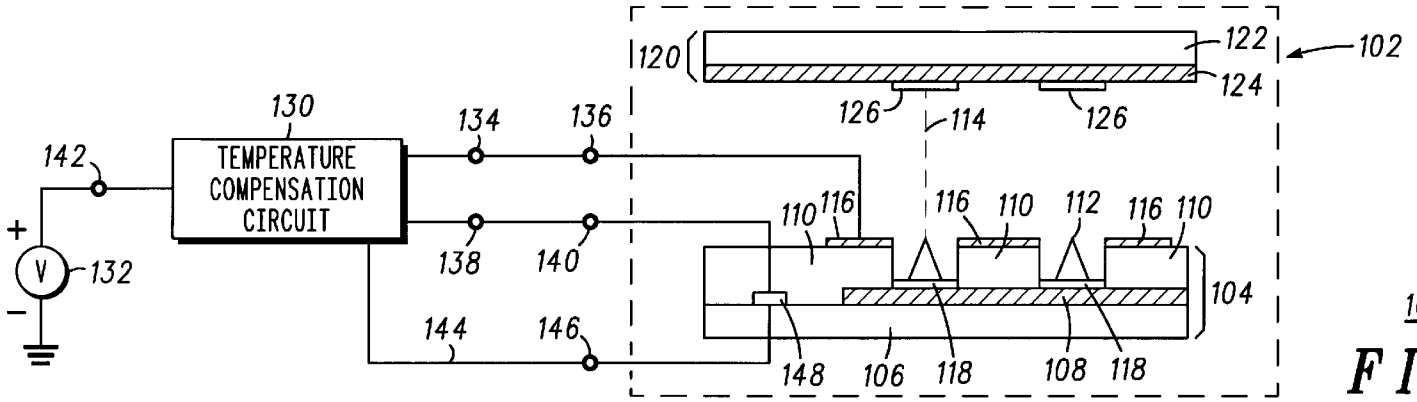
FIG.1 is a cross-sectional view of a field emission display in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENT

The preferred embodiment of the invention is for a field emission display having a temperature sensing element and a method of operating the field emission display. The temperature sensing element of the invention provides numerous advantages. For example, the temperature sensing element, in conjunction with a temperature compensation circuit, emulates the temperature vs. resistance characteristics of the ballast resistors and adjusts electron emission current for changes in temperature of the field emission display. By adjusting the electron emission current for changes in temperature, the brightness of the field emission display is maintained constant over variations in temperature of the FED.

The preferred method of operating the field emission display in accordance with the preferred embodiment of the invention includes the steps of conducting a current through the temperature sensing element, thereafter, measuring the ballast voltage across the temperature sensing element, and inputting the ballast voltage to the temperature compensation circuit. Thereafter, the temperature compensation circuit adjusts the gate voltage as a function of the ballast voltage across the temperature sensing element. The gate voltage, thereafter, adjusts the electron emission current of the emitters. The step of adjusting the electron emission current is preferably controlled in order to maintain the brightness of the field emission display at a constant level over variations in temperature. The preferred method of the invention measures the change in resistance of the temperature sensing element over variations in temperature, which corresponds to the temperature vs. resistance characteristics of the ballast resistors.

FIG. 1 is a cross-sectional view of a field emission display 100 in accordance with a specific implementation of the preferred embodiment of the invention. Field emission display 100 includes a display device 102 and a temperature compensation circuit 130.

Display device 102 includes a cathode plate 104 and an anode plate 120 in registration with cathode plate 104. Cathode plate 104 includes a substrate 106, which can be made from glass, silicon, and the like. A plurality of cathodes 108 is disposed on substrate 106. Cathodes 108 can include a plurality of ballast resistors 118 for limiting electron emission current 114 through electron emitters 112. A dielectric layer 110 is disposed upon cathodes 108 and substrate 106, and further defines a plurality of wells.

An electron emitter 112 is disposed in each of the wells. Anode plate 120 is disposed to receive electron emission current 114 emitted by electron emitters 112. A plurality of gates 116 is formed on dielectric layer 110 proximate to the wells. Cathodes 108 and gates 116 are used to selectively address electron emitters 112.

A temperature sensing element 148 is disposed on substrate 106 separate from cathode 108 and ballast resistors 118. Temperature sensing element 148 is preferably made from a high resistivity material, most preferably amorphous silicon. In the preferred embodiment, temperature sensing element 148 and ballast resistors 118 are made from the same material. Cathode plate 104 of field emission display 100 can include more than one temperature sensing element 148. In the preferred embodiment cathode plate 104 includes one temperature sensing element 148.

Temperature sensing element 148 is preferably placed on substrate 106 at the same time as ballast resistors 118. In this manner, the temperature vs. resistance characteristics of temperature sensing element 148 is the same as those of ballast resistors 118. This feature ensures that temperature vs. resistance characteristics of temperature sensing element 148 match those of ballast resistors 118, even though the actual temperature vs. resistance characteristics may vary from FED to FED. This feature also reduces the electronics currently used in the art in an attempt to mimic the temperature vs. resistance characteristics of ballast resistors 118.

Preferably, temperature sensing element 148 is placed on substrate 106 separate from ballast resistors 118. Methods for fabricating ballast resistors 118 for field emission displays are also well known to one of ordinary skill in the art.

To facilitate understanding, FIG. 1 depicts only a few gates and one cathode. However, it is desired to be understood that any number of gates and cathodes can be employed. An exemplary number of gates for display device 102 is 240 gates, and exemplary number of cathodes is 720 cathodes. Methods for fabricating cathode plates for matrix-addressable field emission displays are also well known to one of ordinary skill in the art.

Anode plate 120 includes a transparent substrate 122 made from, for example, glass. An anode 124 is disposed on transparent substrate 122. Anode 124 is preferably made from a transparent conductive material, such as indium tin oxide. In the preferred embodiment, anode 124 is a continuous layer that opposes the entire emissive area of cathode plate 104. That is, anode 124 opposes the entirety of electron emitters 112. A plurality of phosphors 126 is disposed upon anode 124. Methods for fabricating anode plates for matrix-addressable field emission displays are also known to one of ordinary skill in the art.

In the preferred embodiment of the invention, a temperature compensation circuit 130 is functionally connected to temperature sensing element 148 and gate 116. Temperature compensation circuit 130 operates to measure changes in resistance as a function of temperature of temperature sensing element 148. Temperature compensation circuit 130 further adjusts gate voltage 238 to affect adjustment in electron emission current 114.

An input 142 of temperature compensation circuit 130 is designed to be connected to an unregulated voltage 132. An output 134 of temperature compensation circuit 130 is connected to input 136 of gate 116. A current output 138 of temperature compensation circuit 130 is connected to a first terminal 140 of temperature sensing element 148. A second terminal 146 of temperature sensing element 148 is connected to a power conductor 144.

Figure 2:
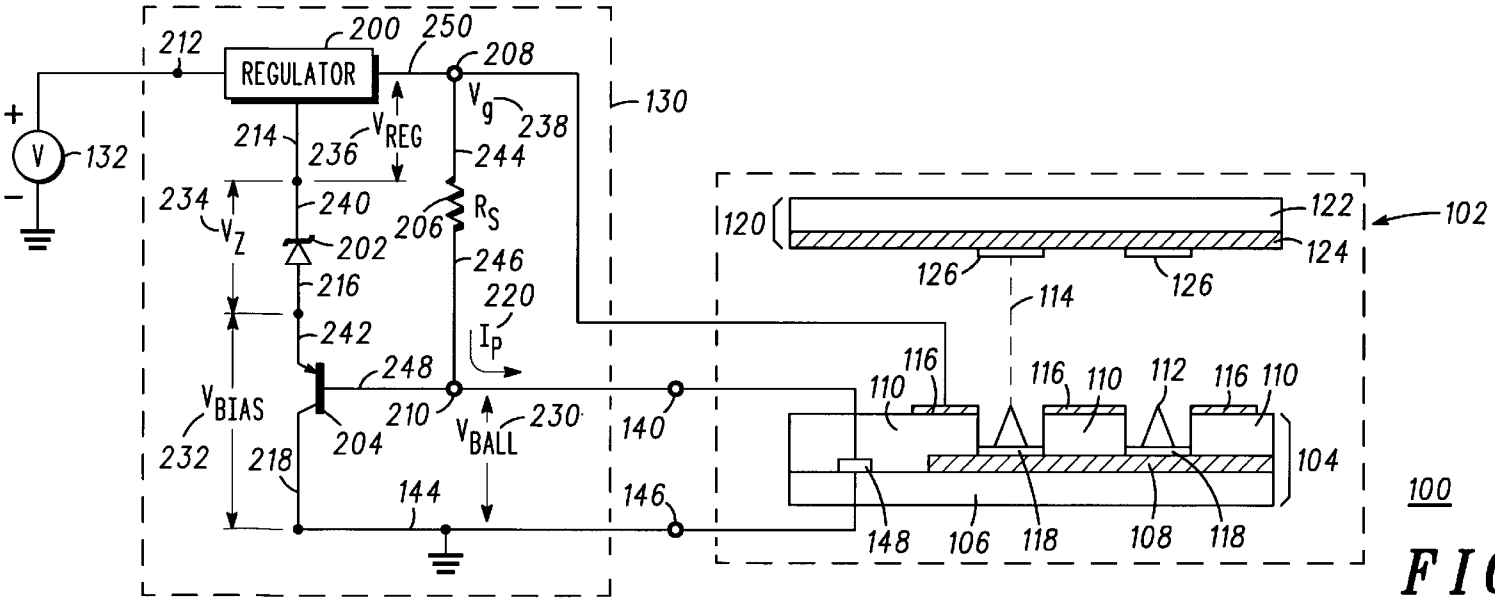
FIG.2 is a circuit diagram of a field emission display having a temperature compensation circuit in accordance with the preferred embodiment of the invention.

FIG. 2 is a circuit diagram of field emission display 100 in accordance with a specific implementation of a preferred embodiment of the invention. In the embodiment of FIG. 2, the preferred temperature compensation circuit 130 includes a regulator 200, a zener diode 202, a transistor 204, and a resistor 206. Input terminal 212 of regulator 200 is connected to unregulated voltage 132 via input 142 to temperature compensation circuit 130. First terminal 250 of regulator 200 is commonly connected to a first node 208 and first terminal 244 of resistor 206. Second terminal 214 of regulator 200 is connected to first terminal 240 of zener diode 202. Second terminal 246 of resistor 206 is commonly connected to second node 210 and control terminal 248 of transistor 204. First conducting terminal 242 of transistor 204 is connected to second terminal 216 of zener diode 202. Second conducting terminal 218 of transistor 204 is connected to the power conductor 144.

Second node 210 is further connected to first terminal 140 of temperature sensing element 148. Power conductor 144 is connected to second terminal 146 of temperature sensing element 148. First node 208 is further connected to gate 116.

The operation of field emission display 100 will now be described with reference to FIG. 2. The initial step is for temperature compensation circuit 130 to generate current 220, $I_p$. Regulator 200 receives unregulated voltage 132 and outputs a regulated voltage 236, $V_{Reg}$, to first node 208. Zener diode 202 is connected to regulator 200 and maintains a zener voltage 234, $V_z$. Current 220, $I_p$, generated across resistor 206, is conducted across temperature sensing element 148. Current 220, $I_p$, is proportional to electron emission current 114, wherein the proportionality constant is set in accordance with the value of resistor 206. In the preferred embodiment, current 220, $I_p$, is selected to be equal to electron emission current 114.

The current 220, $I_p$, is substantially equal to:

$$I_p \cong (V_{Reg}+V_z)/R_s$$

where:

$R_s$ is resistance of resistor 206.

Conducting current 220, $I_p$, across temperature sensing element 148, subsequently generates a ballast voltage 230, $V_{Ball}$, which is input to temperature compensation circuit 130. Ballast voltage 230, $V_{Ball}$, is input between second node 210 and second conducting terminal 218 of transistor 204. By way of example, transistor 204 is a PNP bipolar junction transistor (PNP BJT). Transistor 204 outputs bias voltage 232, $V_{Bias}$, between first conducting terminal 216 and second conducting terminal 218 of transistor 204.

Subsequent to the generation of bias voltage 232, $V_{Bias}$, gate voltage 238, $V_g$, is adjusted, as a function of bias voltage 232, $V_{Bias}$, to control electron emission current 114. While regulated voltage 236, $V_{Reg}$, and zener voltage 234, $V_Z$, are constant, bias voltage 232, $V_{Bias}$, will vary as a function of ballast voltage 230, $V_{Ball}$. Ballast voltage 230, $V_{Ball}$, will vary as a function of the temperature of temperature sensing element 148. Gate voltage 238, $V_g$, is the sum of regulated voltage 236, $V_{Reg}$, zener voltage 234, $V_z$, and bias voltage 232, $V_{Bias}$. Therefore, gate voltage 238, $V_g$, will vary as a function of ballast voltage 230, $V_{Ball}$. Gate voltage 238, $V_g$, is output to gate 116 and controls electron emission current 114.

By way of example, zener voltage 234, $V_z$, is about 5 volts, regulated voltage 236, $V_{Reg}$, is about 40 volts, and current 220, $I_p$ is about 1 micro amp. The values given for voltage and current are not limitations of the present invention. In other words, other values for voltage and current can be used.

In summary, the preferred embodiment of the invention is for a field emission display having a temperature sensing element and a method of operating the field emission device. The temperature sensing element is disposed directly on the cathode plate separate from the ballast resistors. Preferably, the temperature sensing element matches the temperature vs. resistance characteristics of the ballast resistors, and in conjunction with the temperature compensation circuit, provides the benefit of adjusting the electron emission current for changes in temperature of the cathode plate and ballast resistors. This provides the further benefit of constant display brightness throughout variations in temperature.

The preferred embodiment of the invention provides yet another benefit in reducing the use of complex electronics in an attempt to mimic the temperature vs. resistance characteristics of the ballast resistors and thereafter adjust electron emission current as a function of temperature. The invention also eliminates the use of inaccurate means of measuring temperature vs. resistance characteristics of ballast resistors such as pn junctions and thermistors. Yet a further benefit of the invention eliminates the concern of temperature vs.

resistance characteristics of ballast resistors varying from FED to FED. The invention ensures that the temperature sensing element of each particular FED matches the temperature vs. resistance characteristics of the ballast resistors of that FED.

The preferred method for operating a field emission display in accordance with the invention includes the steps of conducting a current through the temperature sensing element, thereafter, measuring the ballast voltage generated across the temperature sensing element, and inputting the ballast voltage to the temperature compensation circuit. Thereafter, the temperature compensation circuit adjusts the gate voltage as a function of the ballast voltage across the temperature sensing element. The gate voltage, thereafter, adjusts the electron emission current of the emitters. The method of the invention provides the benefit of providing constant display brightness throughout variations in temperature.

While we have shown and described specific embodiments of the present invention, further modifications and improvements will occur to those skilled in the art. We desire it to be understood, therefore, that this invention is not limited to the particular forms shown and we intend in the appended claims to cover all modifications within the spirit and scope of this invention.

We claim:

1. A field emission display comprising:

a cathode plate having a plurality of electron emitters;

an anode plate disposed to receive an electron emission current from said plurality of electron emitters;

a temperature sensing element disposed on said cathode plate for measuring temperature changes in said cathode plate; and a temperature compensation circuit, connected to said temperature sensing element, for adjusting said electron emission current of said electron emitters based on temperature changes measured in said cathode plate.

2. The field emission display as claimed in claim 1, wherein said temperature compensation circuit controls said electron emission current through said plurality of electron emitters as a function of temperature of said cathode plate.

3. The field emission display as claimed in claim 2, wherein said cathode plate further comprises:

a plurality of ballast resistors disposed on said cathode plate and coupled to said electron emitters; and wherein said temperature sensing element is disposed on said cathode plate separate from said plurality of ballast resistors.

4. The field emission display as claimed in claim 3, wherein said plurality of ballast resistors and said temperature sensing element are comprised of a same material.

5. The field emission display as claimed in claim 3, wherein said temperature sensing element is comprised of amorphous silicon.

6. The field emission display as claimed in claim 3, wherein said temperature sensing element conducts a current, and wherein said current generates a ballast voltage across said temperature sensing element as a function of temperature of said cathode plate.

7. The field emission display as claimed in claim 6, wherein said temperature compensation circuit receives said ballast voltage and generates a gate voltage, said temperature compensation circuit controlling said electron emission current through said plurality of electron emitters as a function of temperature of said cathode plate.

8. The field emission display as claimed in claim 7, wherein said temperature compensation circuit further comprises:

a regulator having an input terminal and a first terminal wherein said input terminal is coupled for receiving an unregulated voltage, and wherein said first terminal is coupled for supplying a regulated voltage;

a resistor having a first terminal commonly coupled to a first node and said first terminal of said regulator;

a zener diode having a first terminal coupled to a second terminal of said regulator, wherein said first terminal of said zener diode is coupled for supplying a zener voltage;

a transistor having a control terminal commonly coupled to a second node and a second terminal of said resistor, wherein said second node is coupled for receiving said ballast voltage, and a first conducting terminal of said transistor is coupled to a second terminal of said zener diode, wherein said first conducting terminal of said transistor is coupled for supplying a bias voltage, and a second conducting terminal of said transistor is coupled to a power conductor; and wherein said temperature compensation circuit receives said ballast voltage at said control terminal of said transistor as a function of temperature of said temperature sensing element, wherein said transistor outputs said bias voltage across said first conducting terminal and said second conducting terminal of said transistor, wherein said gate voltage is the sum of said regulated voltage, said zener voltage and said bias voltage, wherein said gate voltage is output to control said electron emission current.

9. The field emission display as claimed in claim 8, wherein said temperature sensing element further comprises a first terminal coupled for receiving said current and supplying said ballast voltage, and a second terminal coupled to a power conductor.

10. A field emission display comprising:

a cathode plate having a plurality of electron emitters;

an anode plate disposed to receive an electron emission current by said plurality of electron emitters; and temperature sensing means disposed on said cathode plate for measuring temperature changes in said cathode plate.

11. A method of adjusting electron emission current in a field emission display as a function of temperature, said method comprising the steps of:

providing a field emission display with a cathode plate having a plurality of electron emitters and a plurality of ballast resistors;

providing an anode plate in registration with said cathode plate;

measuring temperature changes of said cathode plate; and adjusting electron emission current of said electron emitters based on temperature changes of said cathode plate.

12. The method of claim 11, further comprising the steps of:

providing a temperature sensing element disposed on said cathode plate separate from said plurality of ballast resistors;

providing a temperature compensation circuit connected to said temperature sensing element;

conducting a current through said temperature sensing element; and generating a ballast voltage across said temperature sensing element, wherein said ballast voltage is a function of temperature of said cathode plate.

13. The method of claim 12, further comprising the steps of:

feeding said bias voltage to said temperature compensation circuit;

generating a gate voltage from said temperature compensation circuit for controlling an electron emission current through said plurality of electron emitters; and adjusting said electron emission current through said plurality of electron emitters as a function of temperature of said cathode plate based on said gate voltage generated.

14. The method of claim 12 further comprising the step of forming said plurality of ballast resistors and said temperature sensing element from a same material.

15. The method of claim 12 further comprising the step of forming said temperature sensing element from amorphous silicon.

* * * * *